US006594961B2

(12) United States Patent
Leines

(10) Patent No.: US 6,594,961 B2
(45) Date of Patent: Jul. 22, 2003

(54) DECK PLANK EXTRUSION AND RETAINING CLIP

(76) Inventor: Richard Alan Leines, 2282 Tamarisk Ct., Discovery Bay, CA (US) 94514

( * ) Notice: Subject to any disclaimer, the term of this patent is extended or adjusted under 35 U.S.C. 154(b) by 0 days.

(21) Appl. No.: 09/827,536

(22) Filed: Apr. 6, 2001

(65) Prior Publication Data

US 2002/0056238 A1 May 16, 2002

Related U.S. Application Data

(63) Continuation-in-part of application No. 09/575,420, filed on May 20, 2000, now abandoned.

(51) Int. Cl.[7] ..... E04F 15/00; E04B 2/30; E04B 2/08; E04H 12/00

(52) U.S. Cl. ..... 52/177; 52/181; 52/589.1; 52/650.3; 52/489.2; 52/489; 52/483.1

(58) Field of Search ..... 52/177, 483.1, 52/489.1, 489.2, 650.3, 480, 403.1, 181, 588.1, 589.1, 592.1

(56) References Cited

U.S. PATENT DOCUMENTS 3,946,529 A 3/1976 Chevaux
4,078,515 A * 3/1978 Svirklys
5,009,045 A * 4/1991 Yoder
5,351,458 A 10/1994 Lehe
5,553,427 A * 9/1996 Andres
5,617,689 A * 4/1997 Beane
5,623,803 A 4/1997 Willis
5,642,592 A * 7/1997 Andres
5,660,016 A 8/1997 Erwin et al.
5,735,097 A 4/1998 Cheyne
5,819,491 A 10/1998 Davis
5,950,377 A * 9/1999 Yoder
6,044,598 A * 4/2000 Elsasser
6,112,479 A 9/2000 Andres
6,199,340 B1 * 3/2001 Davis
6,233,886 B1 * 5/2001 Andres
6,301,842 B1 * 10/2001 Chaney

* cited by examiner

*Primary Examiner*—Carl D. Friedman
*Assistant Examiner*—Kevin McDermott
(74) *Attorney, Agent, or Firm*—David Pressman

(57) ABSTRACT

A deck plank (12) readily attaches to an engagement clip (46) when force is applied over the plank. When a plurality of clips are attached to underlying joists in parallel with the joists, and a plurality of deck planks are oriented to the clip perpendicular to the joist and pushed down over clips, a secure deck structure is provided. Each clip has a pair of horizontal flanges (52 and 54), which snap over a plurality of ledges (42 and 44) in a channel under each plank. The deck planks (12) are embossed (14) so as to form a slip resistant surface to be walked upon. The plastic extruded deck plank (12) resists rot, deterioration and insect infection found in current wood products. The deck plank assembly is simple enough so that a homeowner or do-it-yourselfer can install or alter it with minimal effort and direction.

37 Claims, 7 Drawing Sheets

DECK PLANK EXTRUSION AND RETAINING CLIP

CROSS-REFERENCE TO RELATED APPLICATIONS

This is a continuation-in-part of application Ser. No. 09/575,420, filed May 20, 2000 now abandoned.

FEDERALLY SPONSORED RESEARCH

None

BACKGROUND—FIELD OF INVENTION

This invention relates to deck planks, specifically to an easily installed and user-friendly plank and retaining clip which attaches to wood or metal joists and the like used to form the supporting structure of a deck or dock.

BACKGROUND—DESCRIPTION OF PRIOR ART

Usually a deck or boat dock is constructed of horizontal wood members (ledgers or putlogs) which support a finish surface layer, typically wood planks. Such decks or docks (hereinafter decks) are exposed to the environment and thus tend to rot and decay. Even redwood and pressure-treated lumber used for deck planks often needs regular annual maintenance that is costly as well as a nuisance. Often when the deck deteriorates, the supporting structure or joists are also likely to deteriorate; thus expensive repairs are needed.

Plastic extruded deck planks have been used in the past, but these have disadvantages, such as an irritable squeaking sound when the planks are walked upon due to rubbing together and the method of connection. Plastic planks are also very difficult to install properly without expert help, which adds tremendously to the cost of the residential homeowner's project.

U.S. Pat. No. 5,009,045 to Yoder (1991) shows a clip strip used to attach the deck plank to the floor assembly. The labor and skill required to engage the plank to the clip correctly is so great that professional help is often needed for proper installation. Once engaged, the deck plank is difficult to disengage (e.g., for remodeling) without damage to plank or clip. Also the plank is not able to span existing joist spacing easily when replacing a deck surface. U.S. Pat. No. 5,950,377 to Yoder (1996) shows a clip strip used to attach the deck plank to the floor assembly. Again, the labor and skill required to engage the plank to the clip correctly is so great that professional help is often needed for proper installation. Once engaged, the deck plank is difficult to disengage (e.g., for remodeling) without damage. Also the plank is not able to span existing joist spacing easily when replacing a deck surface.

U.S. Pat. No. 5,642,592 to Andres (1997) shows an engagement strip that runs perpendicular to the supporting members in the same direction as the deck planks. These strips must be fully engaged along the full length of the plank. If this is not done, the plank will rub and make noise due to the lack of full engagement. The installation of these strips is also tedious and time consuming and will have an unsightly appearance if due care is not taken upon installation.

U.S. Pat. No. 6,112,479 to Andres (2000) shows a snap connector strip that runs generally perpendicular to the horizontal surface of wood joists in the same direction as the deck plank. These strips have an elongated base portion and must be fully engaged along the full length of the plank, as is required in the strip of the Andres U.S. Pat. No. 5,642,592. If this is not done, the plank will rub and make noise due to lack of full engagement, an inherent disadvantage of this design. The installation of these strips is also tedious and time consuming and will have an unsightly appearance if due care is not taken during installation. This strip system is not conducive to placement over flat surfaces due to the inability of the strips to fully engage themselves; thus noise is created from the plank and strip rubbing together.

U.S. Pat. No. 4,965,980 to Leavens (1990) shows a deck, sold under the trademark Deckmaster, by Contemporary Sundecks and Patio Covers, Inc., Sebastopol, Calif. A bracket is attached to the joist with screws and boards are attached to the brackets. Screws are then driven from the underside of the deck planks through the bracket and into the bottom of the planks. Although the screws are hidden from the top surface of the planks, the installation is tedious and must be performed by either working from the underside of the deck structure or by bending over and reaching under the deck boards in order to fasten the screws to the deck boards. This form of attachment is cumbersome and expensive. Also, it is not an easy way to remove the plank from the bracket.

Existing plastic extruded deck plank assemblies are labor intensive and require a great deal of skill to install. It is also difficult to disengage the deck plank for repairs or alterations.

Insofar as I am aware all existing deck layer are either difficult to assemble and/or are laid out non-uniformly. Most residential homeowners can neither install the plank assembly if desired, nor repair and alter the deck if needed.

BACKGROUND—OBJECTS AND ADVANTAGES

Accordingly, several objects and advantages of my invention are:

(a) to provide an improved deck structure, (b) to provide a deck plank that can be engaged to its attachment device in a manner that does not require a great deal of skill or effort, (c) to provide a deck plank which will engage easily, yet remain in place for its primary use, (d) to provide a deck plank which will assemble in a uniform manner, giving ease of layout to those skilled or unskilled in the art, (e) to provide a deck plank which can be disengaged readily with little effort, (f) to provide a deck plank and engagement clip which will engage mechanically in such a manner as to allow the planks to expand and contract naturally and freely in the bounds of their assembly without damage, (g) to provide a track assembly which will aid in ease and speed of installation for the home owner.

Further objects and advantages are to provide a deck plank which will have skid resistance and aesthetically pleasing qualities, which does not require costly or labor intensive annual maintenance, that is rot and insect resistant, and which can be installed by residential homeowners. Still further objects and advantages will become apparent from a consideration of the ensuing description and drawings.

SUMMARY

In accordance with the invention I provide a new plastic plank and retaining clip or track. The plank has an oblique-supporting panel which provides space for an end of an engaging clip to be fastened to a joist, while keeping fastening screws concealed from the plank surface. The oblique-supporting panels also add strength to the plank structure; this keeps the plank straight, while providing the benefits mentioned above. An engaging ledge of the plank is located higher in the recess structure of the plank from that of prior-art planks. This raised position of the engaging ledge creates a better hold between the plank and the engaging clip, which is both advantageous and novel. The improved shape of the ledge allows for an improved engagement and fastening capability.

DRAWING FIGURES

DRAWINGS—REFERENCE NUMERALS

Figure 13:
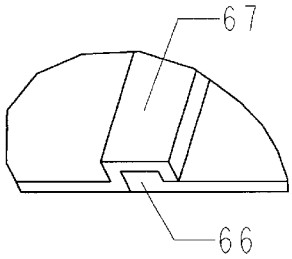
FIG. 13 is an enlarged partial view of FIG. 12 showing a lap over and engagement connection between a plurality of track assembly ends.
Figure 15:
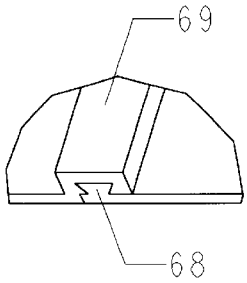
FIG. 15 is an enlarged partial view of FIG. 14 showing a dovetail engagement between a plurality of track assembly ends.
Figure 16:
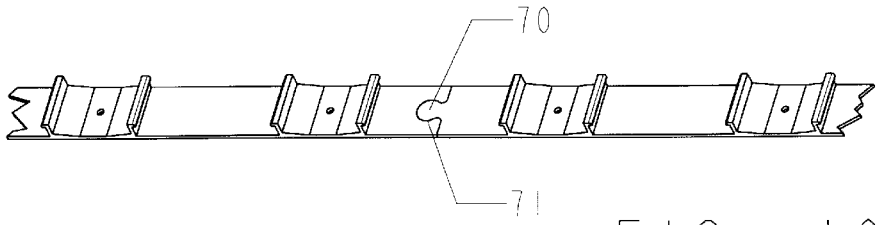
FIG. 16 is an isometric view of an alternative embodiment showing an interlocking engagement between a plurality of track assembly ends.

12—Plank
14—Embossed plank imprint
16—Slip-resistant channel
18—Upper horizontal supporting member
20—Cap stock
22—Substrate
24—Bottom horizontal supporting member
26—Bottom horizontal supporting member
28—Intermediate integral vertical supporting panel
29—Elongated recess
30—Intermediate integral vertical supporting panel
32—Outside vertical supporting panel
34—Outside vertical supporting panel
36—Oblique supporting panel
38—Oblique supporting panel
40—Horizonal stabilizing web
41—Removal tool
42—Engaging ledger
43—Socket slot
44—Engaging ledger
45—Alignment hole
46—Engaging clip
47—Alignment lap joint end of engaging clip
48—Attachment screw
49—Structural supporting member
50—Inner mediate supporting web
51—Inner mediate supporting web
52—Retaining flange projection
53—Attachable deformation
54—Retaining flange projection
55—Alignment notch
56—Elongated track
57—Boss alignment hole
58—Flange boss assembly
59—Attachment hole
60—Alignment lap joint end of engaging track
61—Track angle
62—Flat end of engagement tract
63—Track attachment hole
64—Raised nob
66—First end FIG. 13
67—Second end FIG. 13
68—First end FIG. 15
69—Second end FIG. 15
70—First end FIG. 16
71—Second end FIG. 16

DETAILED DESCRIPTION—FIGS. 1 TO 8—PREFERRED EMBODIMENT

Figure 1:
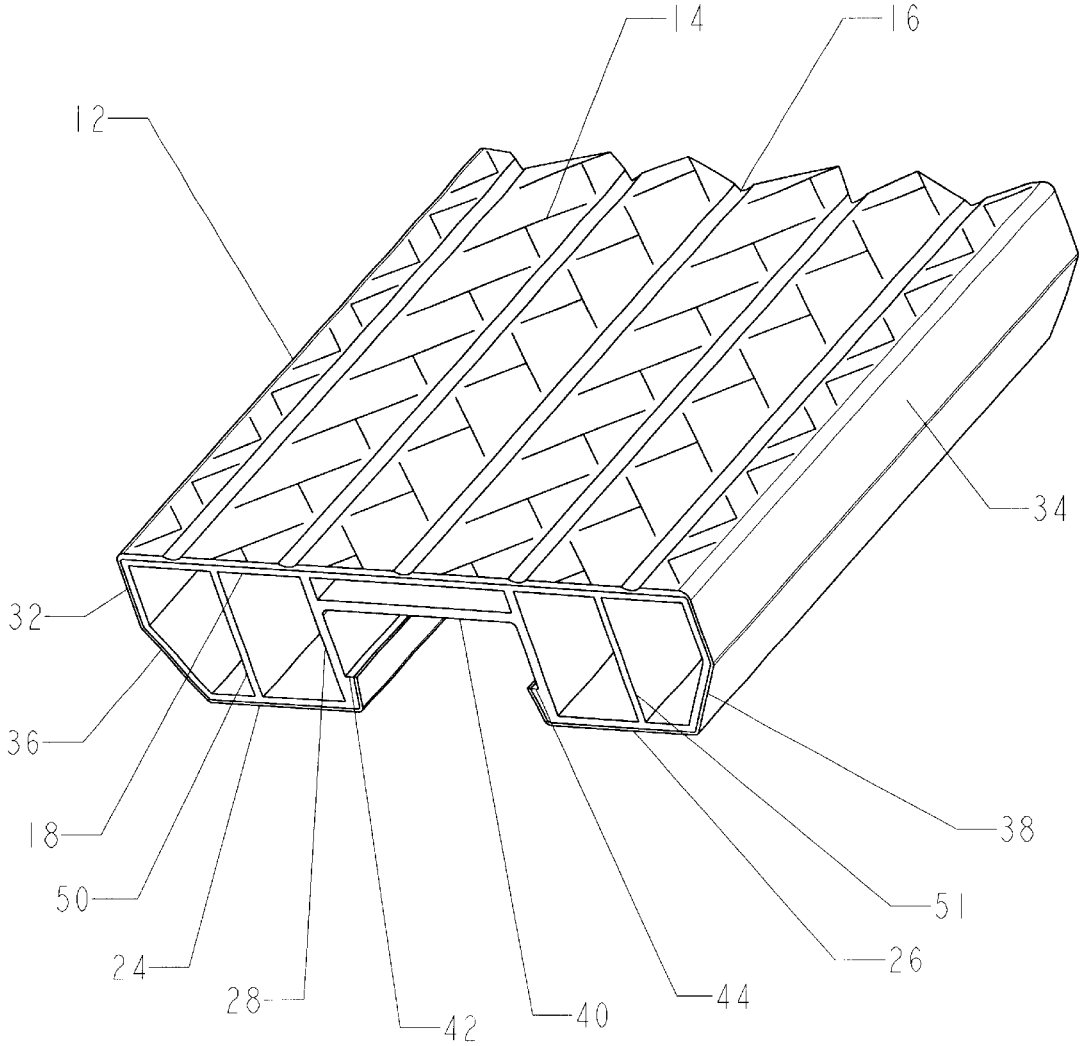
FIG. 1 is a partial perspective view of an extruded plastic deck plank with slip-resistant channels and an embossed top surface, in accordance with the invention.
Figure 4:
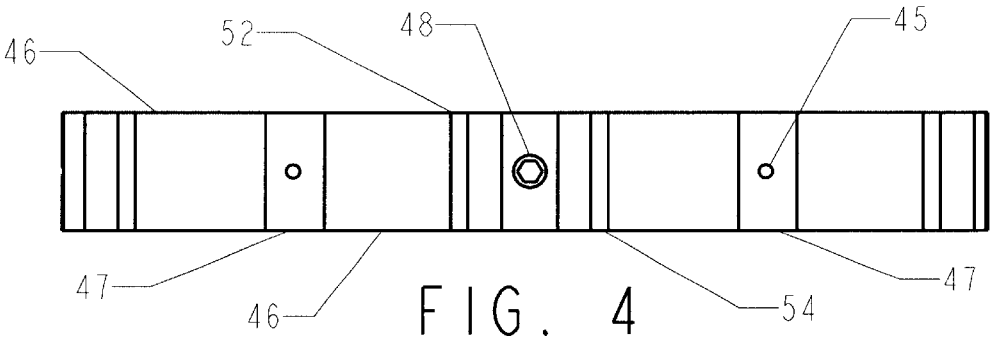
FIG. 4 is a top view of the engagement clip with lines indicating retaining flange projections of the clip body and an alignment lap joint on the engagement clip.
Figure 5:
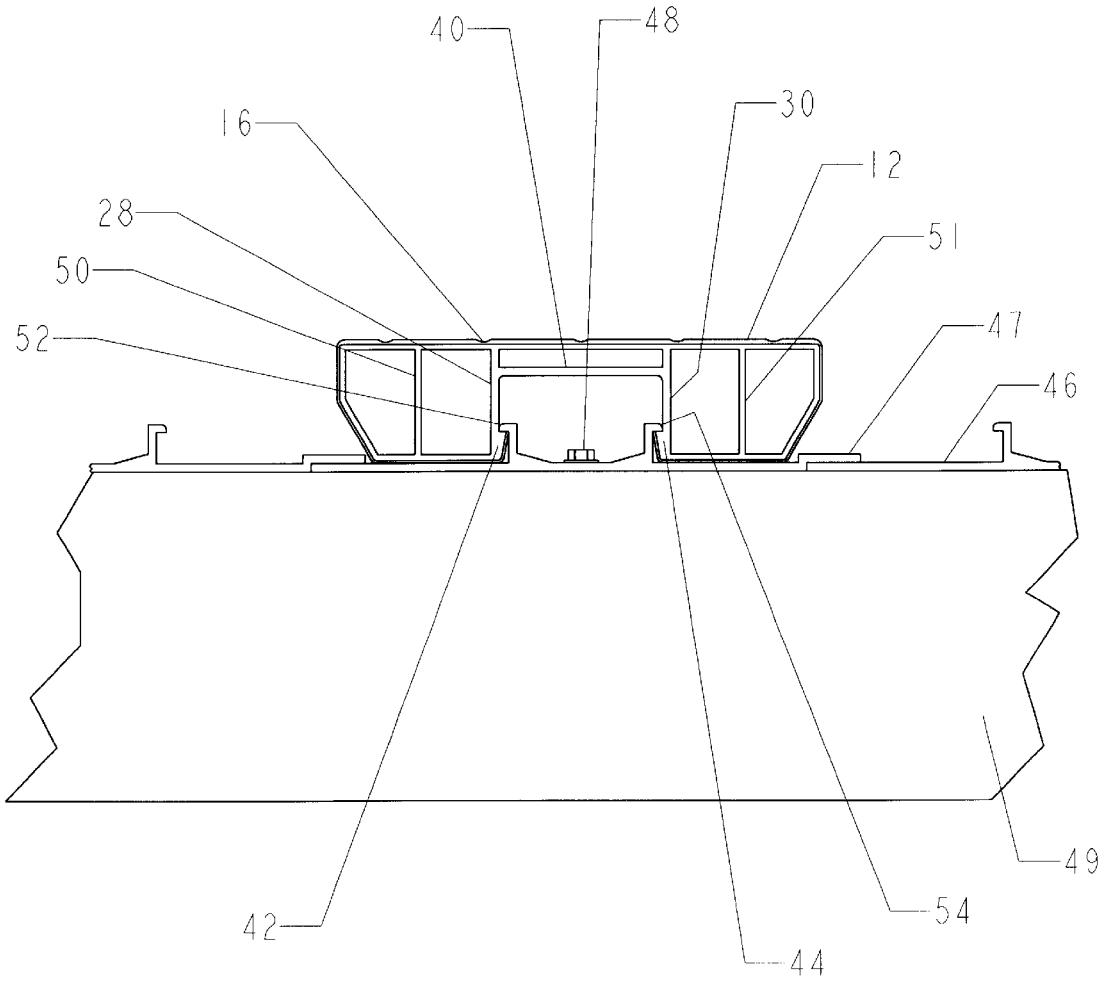
FIG. 5 is an end view of the deck plank and engagement clip showing the deck plank engaged to the engagement clip that in turn is secured to a horizontal-supporting member.
Figure 6:
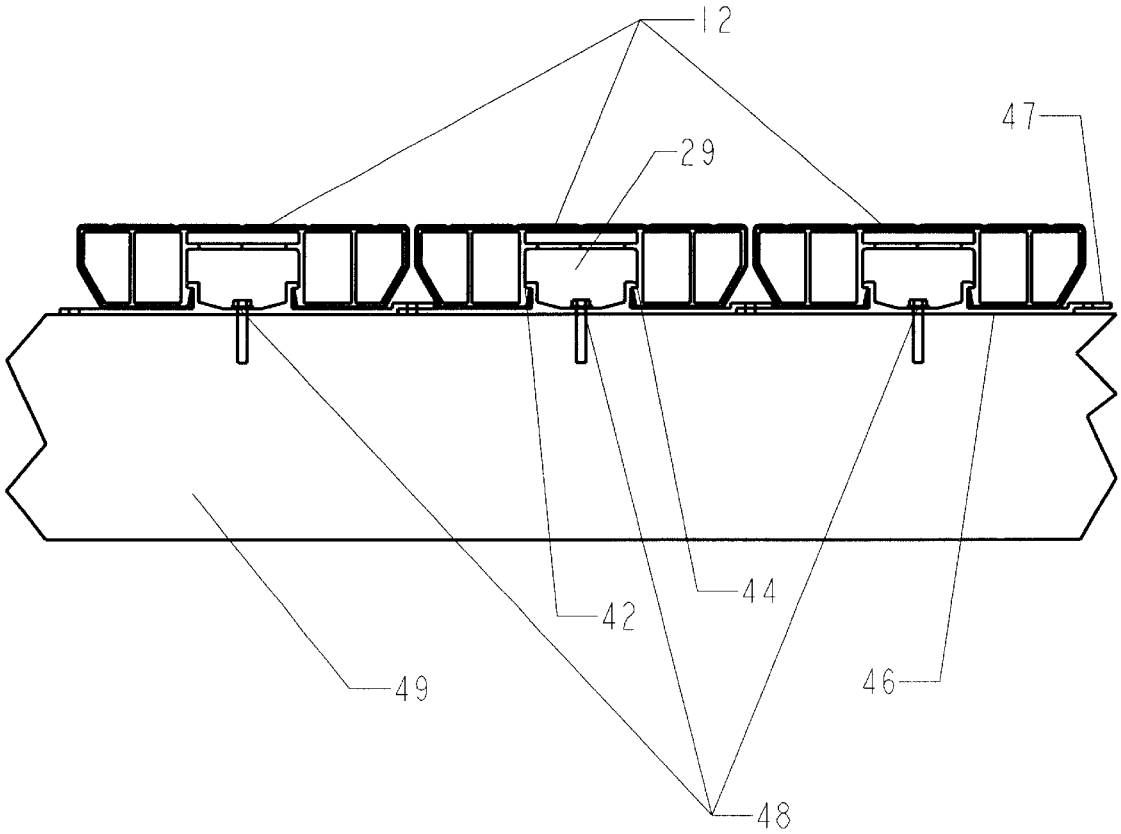
FIG. 6 is an end view of deck plank and engagement clip showing a plurality of deck boards engaged to engagement clips that in turn is secured to the horizontal-supporting member.

A preferred embodiment of the deck plank attachment system of the invention is illustrated in FIG. 1 (partial perspective view) and FIGS. 5 and 6 (end views). A floor assembly consists of several horizontal-supporting stringers or joists, one of which is shown as joist 49 (FIGS. 5 and 6). The joists are spaced parallel to one another. Each joist supports a series of overlapping clips 46, which extend along the top of each joist. A series of deck planks 12 are spaced apart and run perpendicular to the joists. Each plank is held to each joist by one of the overlapping clips along the top of the joist. Each plank perpendicularly overlies a group of parallel joists; e.g., if a plank is 4.88 meters long and the joists are spaced on 40.6 cm centers, then each plank is supported by 13 joists.

In the preferred embodiment, clip 46 is an aluminum extrusion. However, clip 46 can consist of any other suitable material, such as fiberglass, plastic, composite, or an other metal. Deck plank 12 is preferably a plastic, such as polyvinyl chloride. However, plank 12 can consist of composites, fiberglass, another metal, or even wood or wood inlaid with metal ledges.

Figure 3:
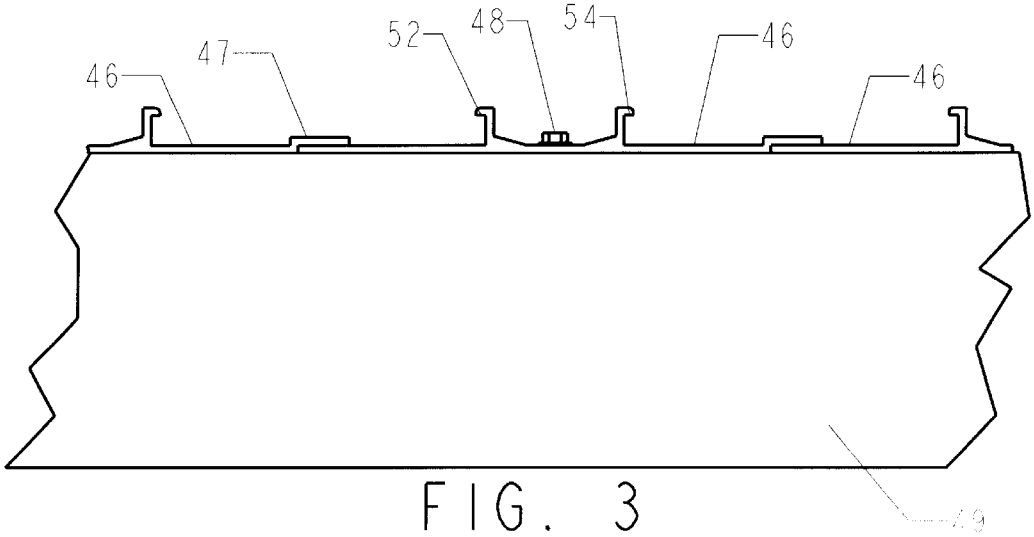
FIG. 3 is a side view of the engagement clip and attachment screw that hold the clip into place.

At one end of each engagement clip 46 is a lap joint end 47 which overlaps a flat end of a previously installed engagement clip 46, as illustrated in FIGS. 3, 5, and 6. An alignment hole 45 is provided in both ends of the clip. These holes aid in aligning adjacent clips: the installer adjusts the clips with the holes of adjacent clips for alignment and this will ensure that the clips form a straight line.

The clip has two upright flange support legs with respective flange projections 52 and 54 (FIG. 3), which extend out horizontally from the upper sides of the legs. The flanges are at a height that allows a connection to be made between engagement clip 46 and deck plank 12.

Deck plank 12 typically has one elongated recess 29 (FIG. 3), which extends along the length of the underside of the deck plank. In other embodiments, there may be a plurality of elongated recesses. In this preferred embodiment the recess is located at the middle of the underside of the deck plank. Engaging ledges 42 and 44 (FIGS. 1 and 2) are located within the elongated recess and extend along the length of the deck plank.

The plank has intermediate integral vertical supporting panels or partitions 28 and 30, which are joined by a horizontal stabilizing web 40 which decreases the spreading capability of the plank, helping it to remain firmly affixed to engagement clip 46 (FIGS. 5 and 6). Web 40 and intermediate vertical supporting panels 28 and 30 extend along the length of the deck plank. Intermediate vertical supporting panels 28 and 30 join upper horizontal supporting member 18 to bottom horizontal supporting members 24 and 26. The plank also has intermediate supporting webs 50 and 51 (FIGS. 1, 2, 5, 6, and 7), which also extend along the length of the deck plank for added structural support.

Bottom horizontal-supporting members 24 and 26 form the base of the deck plank and are directly connected to oblique supporting panels or sections 36 and 38. The oblique panels give structural stability to the deck plank while creating an area or void for a raised portion of the alignment lap joint end 47 of the retaining clip. Outside vertical supporting panels or sections 32 and 34 connect the oblique panels to an upper horizontal-supporting member 18 (FIG. 1).

The horizontal-supporting member has an embossed plank imprint 14, which is integrally formed on the top surface of the deck plank. The top surface has five slip resistant channels 16 extruded along the length of the top surface of the deck plank. Although five channels are shown, the number of channels may vary in alternative embodiments. The four inner surface areas between channels have a "T" pattern and the outer two surfaces have a "V" pattern. However a variety of other patterns or textures or other distortions may be used for the top surface of the deck plank.

Figure 2:
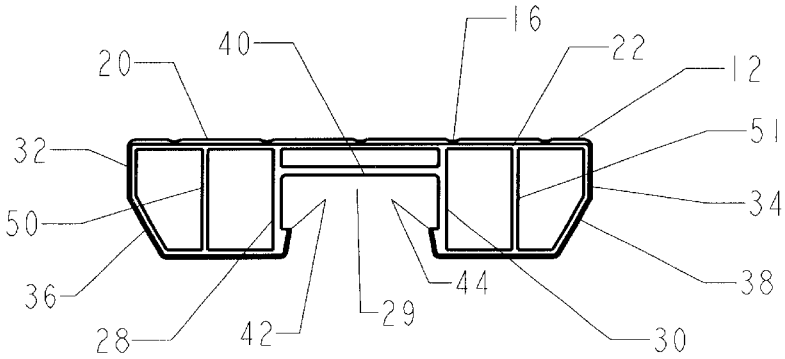
FIG. 2 is an end view of the deck plank shown in FIG. 1, illustrating a concave feature of the slip resistant channel extruded in the top surface of the deck plank.

FIG. 2, an end view of plank 12, shows a cap or outer layer 20 over the top of the plank, which contains ultraviolet inhibitors that protect the vinyl from sunlight. The embossed imprint and slip resistant channels are located within this cap. A substrate 22 or inside layer of the deck plank is preferably polyvinyl chloride and contains reduced ultraviolet protection, making fabrication by a co-extrusion process more affordable without compromising quality or performance.

Figure 7:
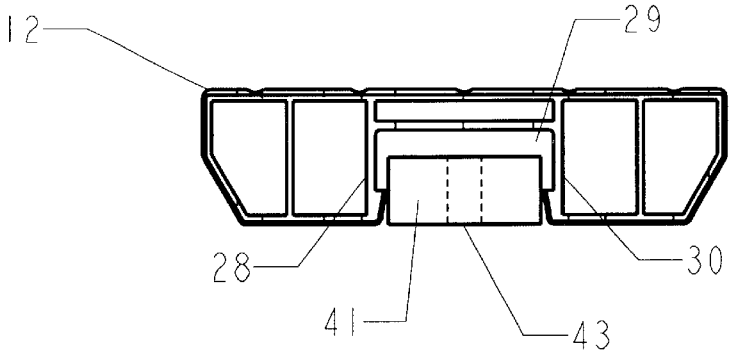
FIG. 7 is an end view of the deck plank and a removal tool inserted into elongated recess of deck plank.

FIG. 7 shows an end or elevational view of deck plank 12 and with a cammable removal tool 41 inserted in elongated recess 29 in the underside of the deck plank.

Figure 8:
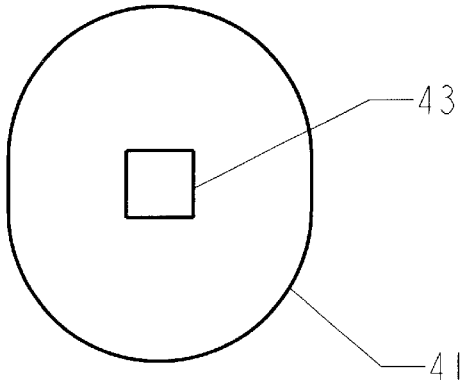
FIG. 8 is a top view of the removal tool, showing a square opening for a socket wrench.

FIG. 8 is a top view of removal tool 41 showing a rectangular opening 43 for a socket wrench to be inserted in the center of the tool.

OPERATION—FIGS. 1 to 5, 7, and 8

The manner of installing the deck plank and retaining clip to floor joists is superior to that of planks in present use. One first installs engaging clips 46 (FIGS. 4 and 9) to a joist 49 with an attachment screw 48 in the center of each clip. A first clip is installed over and parallel to the joist. As shown in FIGS. 3 and 5, succeeding clips are installed in the same manner so that each succeeding clip is parallel to and above the joist and end 47 of one clip overlaps end 46 of the succeeding clip. The clips are installed over and in parallel with all joists over the area to be covered by deck planks.

Next, the installer holds a deck plank directly centered over the pair of flanges 52 and 54 portion of clip 46 so that the elongated recess of the plank aligns with the flanges. Then the installer applies a downward force to deck plank 12. This is most easily done by stepping on deck plank so that the weight of the installer causes inwardly sloping surfaces in the slot under the plank to ride over flanges 52 and 54, whereby the deck plank engages and attaches to clip 46. Specifically retaining flange projections 52 and 54 of the clip will ride over the sloping surfaces and then engage the upper surfaces of ledges 42 and 44 (FIGS. 5 and 6). The installer installs enough clips and planks to cover the entire deck.

To remove deck plank 12 (FIGS. 7 and 8) from engagement clip 46; e.g., for remodeling or alteration or repairs, one inserts tool 41 (FIG. 7), which has a greater length than the space between retaining flanges 52 and 54, under deck plank 12 into elongated recess 29 at one end of the deck plank. The worker then turns tool 41 ninety degrees using a standard socket wrench. This forces the flanges outward and thereby separates the end of the deck plank from ledges 42 and 44, releasing the end from the retaining flange projections 52 and 54 of the clip. The end of the deck plank can now be lifted and removed and in the same manner the rest of the deck plank can be separated and removed off the clips.

If the ends of the planks are not accessible, e.g., due to their abutting a wall, access may be obtained by either crawling under the deck, if accessible, or by ripping a plank or part of a plank so as to gain access to underside of deck structure.

ALTERNATIVE EMBODIMENT—FIGS. 9 to 16

Figure 9:
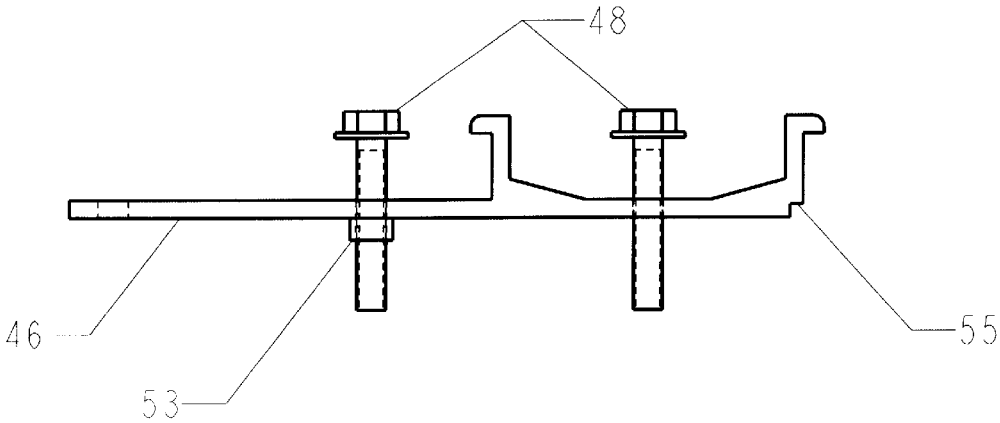
FIG. 9 is an alternative embodiment of clip showing an alignment notch and a deformation from underside of clip used to attach clip to joist or structure.

FIG. 9 is an end view of an alternative embodiment of the clip showing an alignment notch 55 for receiving an opposing end of another clip. A deformation or attachment boss 53 is shown at underside of clip. This deformation may also be extruded, injection molded, or machined in different forms. An attachment screw 48 (FIG. 5) can attach the clip and be so located as to conceal screw 48 from the top surface. This location can be in the center of the flanges 52 and 54 or at the void area between adjacent planks. The top of the clip over deformation 53 can be struck with a hammer to embed deformation 53 in the joist to set clip 46 in place for ease of installation.

Figure 10:
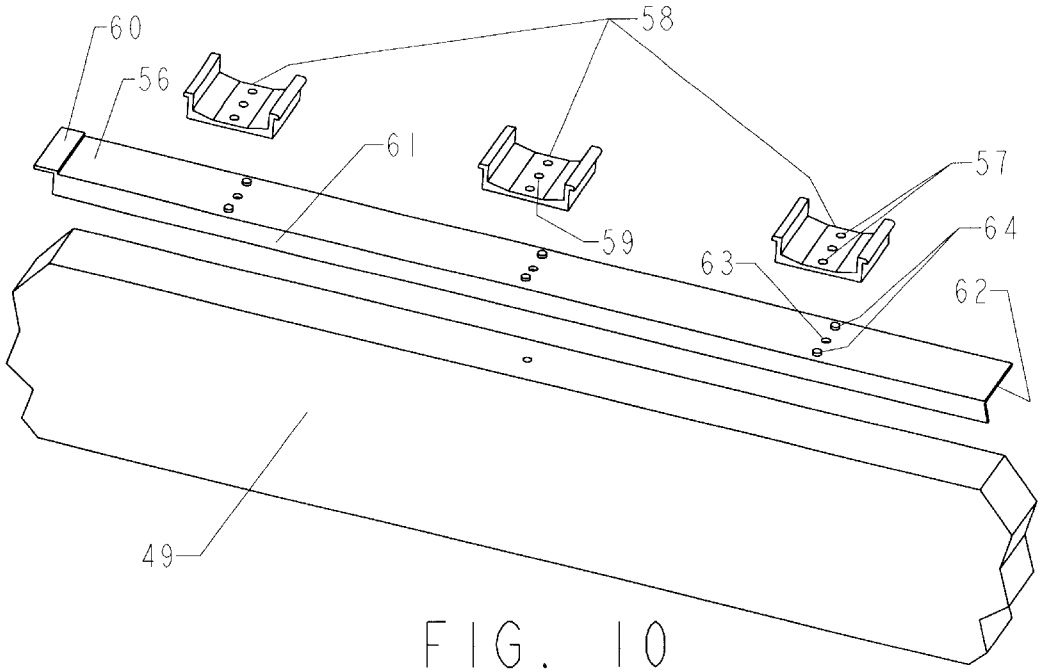
FIG. 10 is an exploded view of an alternative embodiment of an elongated track member showing a plurality of boss assemblies engaged to an elongated track that is secured to the horizontal supporting member.

FIG. 10 is an exploded view of an alternative embodiment of an elongated track assembly. The track assembly shows three flange boss assemblies 58 which can attach to an elongated track portion 56. An attachment screw 48 can secure flange boss assembly 58 to elongated track 56 to structural supporting member 49. An alignment lap joint end of engagement track 60 laps over flat end of engagement track 62. The flange boss assembly 58 has two flanges opposing one another with a middle section which connects the two flanges to form a boss assembly. An attachment hole 59 in the middle of the boss allows for easy installation. A boss alignment hole 57 on either side of attachment hole 59 will intricately engage the raised nob 64 portion of the elongated track 56 to connect the boss assembly and elongated track to form an elongated track assembly. Raised nob 64 and attachment hole 59 can be evenly spaced along the length of the track so a uniform alignment can be maintained with improved accuracy over prior art assemblies. Angle 61 is shown on track assembly 56 which when placed on support member 49 will align itself for ease of installation. Track attachment hole 63 can secure track assembly ends 60 and 62 to support member 49.

Figure 11:
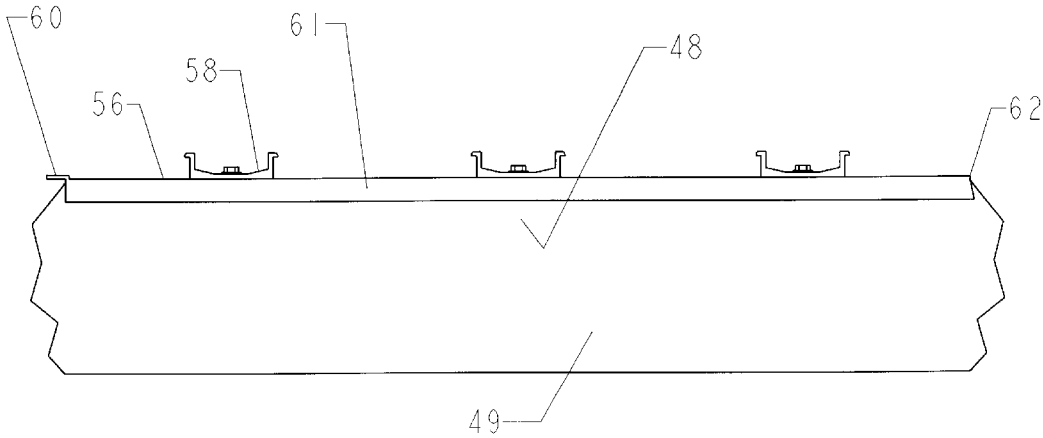
FIG. 11 is a side view of a track assembly attached to a supporting member.

FIG. 11 is a side view of an elongated track assembly 56 attached to supporting member 49. Three boss assemblies are shown attached to the elongated track. The length of the track assembly can be extended since it is an extruded track. The ends of the track can be flat or so formed to interconnect, fasten or engage one another.

In FIG. 10, the elongated track is a two-piece track consisting of elongated track 56 and flange boss assembly 58. The two components of the track can be extruded. However it is possible to have a one-piece track system that is made by a chemical reaction (polymerization) which forms the elongated track and flange bosses in a monolithic pour of a suitable plastic. An elongated injection mold can also produce an elongated track with some limitations compared to an extruded track. Flange boss assembly 58 can also be injected molded and used in conjunction with elongated track 56. The track can also be machine punched to form the flanges and angle portion in a single monolithic operation with extruded or sheared material. The resulting track of an extruded material can be fastened or engaged to form an elongated track for attaching a plurality of deck boards.

The track of FIG. 10 has advantages over present clip strip systems because of the accuracy of the extruded track in length, due to the reduced number of pieces needed to form a completed strip. A side panel 61 can also be placed on at least one side of the elongated portion of the track 56 to help placement and attachment of the track members. Side panel 61 also helps prevent water damage to structural supporting members 49. Deck planks 12 can be installed in a similar manner with the elongated track assembly as with the deck plank and retaining clip to floor joists mentioned earlier in operations section.

Figure 12:
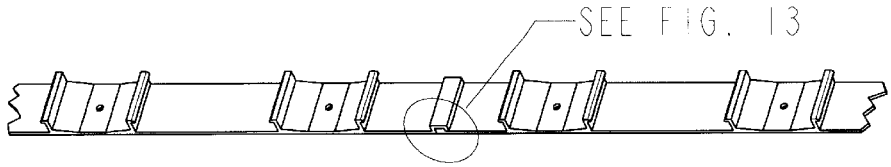
FIG. 12 is an isometric view of an alternative embodiment showing a lap over and engagement connection between a plurality of track assemblies.

FIG. 12 is an isometric view of an alternative embodiment showing a lap over and engagement connection between track assembly ends. A first end 66 has a male projecting portion which engages with a second female receiving portion 67 which connects the ends to form a plurality of elongated track assemblies.

FIG. 13 is an enlarged partial view of the lap over and engagement connection between track assemblies. First end 66 engages with second end 67 when a plurality of track assemblies is required to complete a deck installation.

Figure 14:
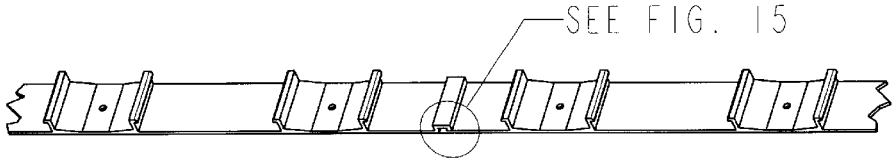
FIG. 14 is an isometric view of an alternative embodiment showing an dovetail engagement between a plurality of track assembly ends.

FIG. 14 is an isometric view of an alternative embodiment showing a dovetail engagement connection between track assembly ends. The first end 68 has a male projecting portion to engage with a second female receiving portion 69 which connects the ends to form a plurality of elongated track assemblies.

FIG. 15 is an enlarged partial view of the dovetail engagement connection between track assemblies first end 68 engages with second end 69 when a plurality of track assemblies is required to complete a deck installation.

FIG. 16 is an isometric view of a further alternative embodiment showing an interlocking engagement between track assembly ends. The first end 71 has a semicircular recessed portion which engages with a second end 70, which has a semicircular flange portion to form a plurality of elongated track assemblies. FIGS. 12 and 14 can have an attachment screw 48 which will secure the two ends to supporting member 49.

ADVANTAGES

From the description above a number of advantages of my deck plank extrusion and retaining clip or track become evident:

(a) The combination of the clip and deck plank allows quick and easy installation by a homeowner.

(b) The embossed imprint and slip resistant channels of my deck plank provides a slip resistant surface to walk upon.

(c) The elongated recess at underside of plank allows access removal of the plank with little effort to disengage nor unsightly damage to the plank from the disengagement process.

(d) The structure and height of the engaging flanges add durability to the flanges and a superior positive connection of the plank to the engagement clip.

(e) The oblique supporting panels add strength to the deck plank by the novel structure of that particular bend in the deck plank, which is not found in other decking extrusions, and which enables the deck plank to maintain form.

(f) The planks can be removed easily for repair, alterations, or remodeling.

(g) The track assembly allows for rapid accurate installation, thus giving the homeowner a friendly system to work with.

CONCLUSION, RAMIFICATIONS, AND SCOPE

Accordingly the reader will see that my deck plank extrusion and retaining clip or track can be used readily in deck and dock applications as well as other uses, such as installing planks over concrete slab floors or other none wood joist floor structures. It can be removed easily when necessary without damaging the retaining clip or engagement flanges. Furthermore, the deck plank and retaining clip have additional advantages in that;

they permit the top surface of the deck plank to be free of unsightly, fasteners that detract from the aesthetic look of the top deck surface;

they provide a superior, embossed slip-resistant surface to walk upon; and they provide a deck that is easily assembled, even by those unskilled in the art.

they provide an elongated track assembly which allows for an easily assembled structure for attaching a plurality of deck boards while holding to greater accuracy which is superior to that of previous inventions.

Although the description above contains many specificities, these should not be construed as limiting the scope of the invention but as merely providing illustration of some of the presently preferred embodiments of this invention, other embodiment are possible. For example, the engagement clip or elongated track assembly can be entirely flat at the bottom with no raised lap joint connections. The engagement clip or track assembly can have a right angle side which rest along the side of a joist for attachment and ease of installation. The engagement clip or track assembly can have deformations located on the bottom or side portion of the clip, which will attach the clip or track to the joist. The engagement clip or track assembly can be shaped to shed water from the clip or track. Fasteners may also be used to attach the clip in a multitude of places. A number of elongated recesses on the deck plank, can be added which will change the shape of the underside of the plank structure as well as the number of flanges needed for the clip to connect and join the two components together. The height of the intermediate horizontal stabilizing web 40 can be raised or lowered within the elongated recess to alter the spreading capability of the deck plank by so positioning the web. Materials such as composites can be used in place of vinyl, as well as a multitude of other plastics, minerals, inorganic, organic, fiberglass, and metal materials, which can be attached over a flat surface rather then joists. Materials such as composites can be extruded in a solid form that matches the outer contours of the mentioned deck profile and use the clip or track attaching method as previously mentioned to attach the deck plank to the clip which is attached to a structural supporting member or joist. The engagement track assembly can have opposing ends which engage each other in a multitude of ways formed by a mechanical or injection molded process.

Therefore, the scope of the present invention should be determined by the appended claims and their legal equivalents, and not by the examples given.

What is claimed is:

1. A clip for easily and quickly attaching a deck board to a surface, comprising:

a bottom portion which can be attached to said surface, said bottom portion having a pair of opposite ends which define the length of said bottom portion, a first flange-support leg extending up from one of said opposite ends of said bottom portion, and a second flange-support leg extending up from the other of said opposite ends of said bottom portion, said first and second flange-support legs being spaced apart from each other by a predetermined leg spacing, a first flange at an upper end of said first flange-support leg and a second flange at an upper end of said second flange-support leg, each of said first and second flanges being spaced up by a predetermined flange height from said bottom portion, said first and second flanges extending away from each other in opposite directions out from said first and second flange-support legs, respectively, said first and second flanges each being substantially shorter than each of said first and second flange-support legs, and means on said bottom portion for attaching said clip to an underlying surface.

2. The clip of claim 1, further including at least one end section extending out from one of said opposite ends of said bottom portion, so that the overall length of said clip is equal to the length of said bottom portion and the length of said end section, said predetermined leg spacing being substantially less than said overall length of said clip.

3. The clip of claim 2, further including an elongated deck board, said deck board having a pair of opposite edges which are spaced apart by a width substantially equal to said overall length of said clip, said deck board having an upper surface and an under side, said under side of said deck board having a bottom surface which is substantially parallel to said upper surface and an elongated recess in a portion of said bottom surface, said elongated recess extending along the length of said deck board, said elongated recess having a pair of sidewalls which directly face each other and which are spaced apart by substantially the same distance as said predetermined leg spacing, said deck board having a pair of side portions on the respective sides of said portion of said bottom surface, said side portions having a width at least equal to the width of said recess, a bottom portion of each of said pair of sidewalls of said elongated recess tapering up and inward toward the opposite sidewall to a ledge which faces upward, so that each of said sidewalls contains an upwardly facing ledge, each ledge extending inward from and spaced up from the bottom of a respective sidewall by a distance substantially equal to said predetermined flange height, said ledges extending into said recess from said respective sidewalls toward each other, said pair of ledges being spaced and shaped to mate with said first and second flanges, respectively, when said deck board is pushed down onto said surface over said clip, such that said first and second flanges extend into said respective recesses and engage said respective ledges, so as to hold said deck board to said clip, whereby said deck board can be connected smoothly and securely to said clip while maintaining a uniform alignment of said elongated deck boards over said surface, yet can be readily disconnected, and such that said deck board can be trimmed in width at said edges of said deck board without disturbing the attachment of said deck board to said clip.

4. The clip of claim 3 wherein said fist and second flange-support legs are substantially equidistantly spaced from the opposite ends of said clip so that said two end sections which extend out from said bottom portion of said clip extend out from said first and second flange-support legs to said opposite ends of said clip and said first and second flange-support legs are centered on said clip.

5. The clip of claim 1, further including two end sections extending out from said opposite ends of said bottom portion, respectively, so that the overall length of said clip is equal to the length of said bottom portion and the length of said two end sections, said predetermined leg spacing being substantially less than said overall length of said clip.

6. A deck structure for attaching a deck board to a surface, comprising:

a clip for attachment to said surface, said clip having a bottom portion which can be attached to said surface, said bottom portion having a length defined by a pair of opposite ends, said clip having a pair of flange-support legs extending up from a center section of said bottom portion, said flange-support legs being spaced in from said opposite ends of said bottom portion and being spaced apart from each other by a predetermined leg spacing; so that two end sections of said bottom portion of said clip extend out from said flange-support legs, respectively, to said opposite ends of said bottom portion, a pair of flanges, each flange being attached to and extending from at an upper end of a respective one of said pair of flange-support legs, so that each flange is spaced up by a predetermined flange height from said bottom portion, said flanges extending in opposite directions and away from each other and generally parallel to said bottom portion, an elongated deck board, said elongated deck board having a width substantially equal to the length of said clip, said deck board having an upper surface and an under side, said under side of said deck board having a bottom surface which is substantially parallel to said upper surface and an elongated recess in a portion of said bottom surface, said elongated recess extending along the length of said deck board, said elongated recess having a pair of sidewalls which directly face each other and which are spaced apart by a distance substantially the same as said predetermined leg spacing, said deck board having a pair of side portions on the respective sides of said portion of said bottom surface, said side portions having a width at least equal to that of said end sections of said bottom portion of said clip, the bottom portion of each of said pair of sidewalls of said elongated recess tapering up and inward toward the opposite sidewall to a ledge which faces upward, so that each of said sidewalls contains an upwardly facing ledge, one ledge extending from and being spaced up from the bottom of each sidewall by a distance substantially equal to said predetermined flange height, said ledges extending into said recess from said respective sidewalls toward each other, said pair of ledges being spaced and shaped to mate with said pair of flanges of said clip when said deck board is pushed down onto said surface over said clip, such that said pair of flanges extend into said recess and engage said ledges, so as to hold said deck board to said clip, whereby said deck board can be connected smoothly and securely to said clip while maintaining a uniform alignment of said elongated deck boards over said surface, yet can be readily disconnected, and such that said deck board can be trimmed in width without disturbing the attachment of said deck board to said clip.

7. The deck structure of claim 6, further including an additional clip, each of said clips having an overlap part at the end of one of said end sections of said clip so that said overlap part can overlap part of the opposite end section of an adjacent clip.

8. The deck structure of claim 7 wherein said clips are mechanically fastened and aligned along said surface so that said overlap parts of two lips overlap, whereby said pair of elongated deck boards can be attached to said clips with predetermined and aesthetically pleasing parallel spacing.

9. The deck structure of claim 6 wherein said deck board is composed of a material selected from the group consisting of metal, wood, plastic, fiberglass, inorganic material, organic material, and mineral material.

10. The deck structure of claim 6 wherein said surface comprises a plurality of parallel, spaced-apart joists.

11. A deck board which can be attached to an underlying surface easily in one downward motion and with a simple clip, comprising:

a deck board of rigid material having a width and a length, the width being substantially less than the length, said deck board having a pair of opposite edges, said opposite edges having a separation that defines said width, said deck board having an upper surface and an under side, said under side of said deck board having a bottom surface which is substantially parallel to said upper surface and an elongated recess in a portion of said bottom surface, said elongated recess extending along the length of said deck board, said elongated recess having a pair of sidewalls which directly face each other and which are spaced apart by a predetermined spacing, a bottom portion of each of said pair of sidewalls of said elongated recess tapering up and inward toward the opposite sidewall to a ledge which faces upward, so that said sidewalls contain a respective pair of upwardly facing ledges, each ledge extending from and being spaced up from the bottom of a respective sidewall by a predetermined distance, said ledges extending into said recess from said respective sidewalls toward each other, whereby said deck board can be connected smoothly and securely to a clip having a pair of outwardly facing flanges while maintaining a uniform alignment of said elongated deck board over said surface, yet can be readily disconnected, and such that said deck board can be trimmed in width at said edges of said deck board without disturbing the attachment of said deck board to said clip.

12. The deck board of claim 11, further including a clip for attaching said deck board to a surface, said clip comprising:

a bottom portion which can be attached to said surface, said bottom portion having a length defined by a pair of opposite ends, a pair of flange-support legs extending up from a section of said bottom portion, said flange-support legs being spaced apart from each other by a predetermined leg spacing which is substantially less than said length of said bottom portion, said flange-support legs being spaced from at least one of said opposite ends of said bottom portion so that at least one end section of said bottom portion of said clip extends out from said flange-support legs to at least one of said opposite ends of said bottom portion, a pair of flanges, each at an upper end of a respective flange-support leg, so that each flange is spaced up by a predetermined flange height from said bottom portion, said flanges extending in opposite directions and away from each other and generally parallel to said bottom portion, each of said flanges being substantially shorter than each of said flange-support legs.

13. The deck board of claim 12 wherein said pair of flange-support legs extend up from a center section of said bottom portion, said flange-support legs being substantially evenly spaced from said respective opposite ends of said bottom portion so that two end sections of said bottom portion of said clip extend out from said flange-support legs to said opposite ends of said bottom portion.

14. A deck structure for attaching a deck board to a surface, comprising:

a clip for attachment to said surface, said clip having a bottom portion which can be attached to said surface, said bottom portion having a length defined by a pair of opposite ends, said clip having a pair of flange-support legs extending up from a center section of said bottom portion, said flange-support legs each having a base and being spaced in from said opposite ends of said bottom portion and being spaced apart from each other by a predetermined leg spacing, so that two end sections of said bottom portion of said clip extend out from said respective bases of said flange-support legs, respectively, to said opposite ends of said bottom portion, a pair of flanges, each at an upper end of a respective flange-support leg, so that each flange is spaced up by a predetermined flange height from said bottom portion, said flanges extending in opposite directions and away from each other and generally parallel to said bottom portion, an elongated deck board having an upper surface and an under side, said under side of said deck board having a bottom surface which is substantially parallel to said upper surface and an elongated recess in a center portion of said bottom surface, said elongated recess having a pair of sidewalls which directly face each other and which are spaced apart by a distance substantially the same as said predetermined leg spacing, said pair of sidewalls of said elongated recess containing a respective pair of upwardly facing ledges, one ledge extending from and being spaced up from the bottom of each sidewall by a distance substantially equal to said predetermined flange height, said ledges extending into said recess from said respective sidewalls toward each other, said pair of ledges being spaced and shaped to mate with said pair of flanges when said deck board is pushed down onto said surface over said clip, such that said pair of flanges extend into said recess and engage said ledges, so as to hold said deck board to said clip, whereby said deck board can be connected smoothly and securely to said clip while maintaining a uniform alignment of said elongated deck boards over said surface, yet can be readily disconnected, and such that said deck board can be trimmed in width without disturbing the attachment of said deck board to said clip.

15. The deck structure of claim 14, further including a second clip so as to provide a pair of clips, one of said opposite end of said first-named clip being joined to one of the opposite ends of said second clip.

16. The deck structure of claim 15 wherein each of said clips comprises a section that can overlap part of an adjacent clip when two clips are placed adjacent to each other.

17. The clips of claim 16 wherein each of said clips is composed of a material selected from the group consisting of metal, wood, plastic, fiberglass, inorganic, and mineral.

18. The deck structure of claim 14 wherein each of said deck boards has a plurality of distortions upon said upper surface.

19. The deck structure of claim 18 wherein said distortions comprise longitudinal grooves upon said upper surface.

20. The deck structure of claim 18 wherein said distortions comprise a multitude of depressions upon said upper surface.

21. The deck structure of claim 14 wherein said deck boards each have a pair of opposite sides which are spaced apart by a distance greater than said predetermined leg spacing, at least one of said opposite sides having a diagonal panel so that when two deck boards are placed adjacent and parallel to each other, a void will be created between said adjacent deck boards, and strength will be added to said deck boards.

22. The deck structure of claim 14 wherein each of said deck boards is composed of plastic.

23. The deck structure of claim 14 wherein each of said sidewalls comprises a tapered portion which extends from a bottom of said sidewall up in an oblique direction into said recess, said ledge which extends into said recess from each sidewall comprising an upper surface of said tapered portion.

24. The deck structure of claim 14, further including a disengagement means for disengaging a board from a respective clip by inserting said disengagement means into said elongated recess and turning said disengagement means to separate said board from said pair of flanges.

25. A method of attaching a deck board to a surface, comprising:

providing a clip for attachment to said surface, said clip having a bottom portion which can be attached to said surface, said bottom portion having a pair of opposite ends which define the length of said bottom portion, said clip having a pair of spaced legs extending up from a center section of said bottom portion, so that each leg has an upper end, each of said legs having a flange attached to and extending out from said upper end, so that said flanges are spaced up from said bottom portion by the length of said legs, said flanges being spaced apart from each other by a flange-spacing distance and extending in opposite directions from each other, a first of said flanges being spaced from one opposite end of said bottom portion by a first given distance and a second of said flanges being spaced from the other opposite end of said bottom portion by a second given distance which is substantially equal to said first given distance, providing an elongated deck board, said deck board having an upper surface and an under surface and a pair of opposite sides connecting said upper surface to said under surface, said opposite sides defining the width of said deck board, said under surface of said deck board having an elongated recess which extends along the length of said board, said elongated recess having a width substantially the same as said flange-spacing distance and substantially narrower than said width of said deck board, such that said deck board has a pair of side portions on opposite sides of said recess, said elongated recess containing a pair of ledges spaced and shaped to mate with said pair of flanges when said deck board is pushed down onto said surface, so as to hold said deck boards to said clip, attaching said deck board to said clip by orienting said deck board over said clip, and pushing down said deck board in a direction substantially normal to said bottom portion of said clip so that said deck board snaps onto said clip, whereby said deck board can be attached rapidly and easily to said surface, and said deck board can be trimmed in width without affecting the attachment of said deck board to said clip.

26. The method of claim 25, further including fastening said clip to said surface by an attachment means, said attachment means comprising a boss extending down from said bottom portion and which can be embedded into said surface when downward pressure is applied onto said clip directly over said boss.

27. The method of claim 26, wherein said clip has a side portion that can rest against a joist for attachment, so that said clip can be fastened to said joist by said side portion of said clip.

28. The method of claim 26, further including a second similar clip which is positioned so that the base portion of said second clip overlaps said first-named clip, and further including a second deck board which is similar to said first-named deck board, so as to provide said pair of deck boards, and attaching said second deck board to said second clip and parallel and adjacent to said first-named deck board, so as to form said void between said adjacent deck boards, said void being positioned over the area of overlap between said clips.

29. The method of claim 25 wherein said deck board has a diagonal panel on at least one of said opposite sides so that when a pair of deck boards are placed adjacent and parallel to each other, a void will be created between said adjacent deck boards, and strength will be added to said deck boards.

30. A deck structure comprising:

a plurality of deck boards, each of said deck boards having a width; and a plurality of clips, each clip having a base portion which has first and second ends which are spaced apart by a first distance defined as the length of said clip, said first end of one clip engaged to said second end of another clip, each of said clips having a deck-board-attachment portion operable to secure a respective one of said deck boards to a respective clip, said deck-board-attachment portion of each clip comprising a pair of legs extending up from said base portion and a respective pair of flanges, one flange disposed at an end of each leg which is distal from said base portion, so that said flanges are spaced from said base portion, said pair of flanges being spaced apart by a second, flange-spacing, distance which is less than said first distance, one of said flanges of said pair of flanges being spaced from said first end of said base portion by a third distance and from said second end of said base portion by a fourth distance which is substantially equal to said second, flange-spacing distance plus said third distance, the other of said flanges of said pair of flanges being spaced from said second end of said base portion by said third distance and from said first end of said base portion by said fourth distance, said flanges extending in opposite directions and away from each other and generally parallel to said bottom portion, each of said deck boards having an having an upper surface and an under side, said under side of each of said deck boards having a bottom surface which is substantially parallel to said upper surface and an elongated recess in a center portion of said bottom surface, each of said deck boards having a pair of clip-attachment ledges operable to secure said deck board to a deck-board-attachment portion of a respective clip, said elongated recess in said center portion of said bottom surface of each deck board having a width substantially equal to said flange-spacing distance, said elongated recess defined by a pair of spaced walls containing said clip-attachment ledges, respectively, said width of each of said deck boards being substantially greater than the width of said elongated center recess, whereby the outside edges of any of said deck boards can be trimmed without interfering with the attachment of said deck board to a clip.

31. The deck structure of claim 30 said wherein said base portion of each of said clips comprises means for attaching said base portion to a supporting surface, said means being located at said deck-board-attachment portion of said clip.

32. The deck structure of claim 31 wherein said base portion of each of said clips is substantially flat, except for said second end, said second end being raised or stepped so as to be able to overlap said first end of an adjacent clip, said deck-board-attachment portion of each of said clips being integral with said base portion of said clip.

33. The deck structure of claim 30 wherein said deck-board-attachment portion of each of said clips comprises a pair of legs which extend up from said base portion and said pair of flanges extend substantially perpendicular to said respective legs.

34. The deck structure of claim 33 wherein said base portion of each of said clips comprises a flat portion and an edge portion which extends perpendicular to said flat portion.

35. The deck structure of claim 30, further comprising means for securing said first end of one of said plurality of clips to said second end of said another of said plurality of clips.

36. The deck structure of claim 30 wherein at least one of said deck boards includes an upper surface and an under surface, said under surface of each of said deck boards having an elongated recess which extends along the length of said board, said elongated recess containing a pair of ledges spaced and shaped to mate with said pair of flanges so that said deck board can be pushed down onto said pair of flanges to attach and hold said deck board to said clip.

37. The deck structure of claim 30 wherein said second end of at least one of said clips has a raised or stepped portion.

* * * * *